United States Patent [19]

Kanada et al.

[11] 4,336,321

[45] Jun. 22, 1982

[54] SILVER HALIDE PHOTOGRAPHIC MATERIALS

[75] Inventors: Eiji Kanada; Yasuo Tsubai; Shoji Yamada; Yoshikazu Takaya; Takao Senga, all of Nagaokakyo, Japan

[73] Assignee: Mitsubishi Paper Mills, Ltd., Tokyo, Japan

[21] Appl. No.: 231,445

[22] Filed: Feb. 4, 1981

[30] Foreign Application Priority Data

Feb. 7, 1980 [JP] Japan ..... 55-13904

[51] Int. Cl.[3] ..... G03C 1/48; G03C 1/34

[52] U.S. Cl. ..... 430/234; 430/581; 430/583; 430/585; 430/270; 430/271; 430/273; 430/569; 430/566; 430/611; 430/614

[58] Field of Search ..... 430/581, 583, 585, 564, 430/611, 251, 234, 566, 270, 271, 273, 569, 961, 231, 614

[56] References Cited

U.S. PATENT DOCUMENTS

| | | | |
|---|---|---|---|
| 2,377,375 | 6/1945 | Russell | 430/961 |
| 3,020,155 | 2/1962 | Yackel et al. | 430/231 |
| 3,226,231 | 12/1965 | Dersch et al. | 430/611 |
| 3,438,776 | 4/1969 | Yudelson | 430/566 |
| 3,507,658 | 4/1970 | Dersch et al. | 430/611 |
| 3,932,186 | 1/1976 | Borror et al. | 430/583 |

*Primary Examiner*—Won H. Louie, Jr.

*Attorney, Agent, or Firm*—Cushman, Darby & Cushman

[57] ABSTRACT

In a silver halide photographic material, at least one mercapto complexing agent for silver salt is contained in at least one photographic constituting layer and at least one anion or betaine type cyanine sensitizing dye is contained in silver halide emulsion layer to improve photographic defects such as reduction of sensitivity, softening in tone, etc.

17 Claims, No Drawings

SILVER HALIDE PHOTOGRAPHIC MATERIALS

BACKGROUND OF THE INVENTION

This invention relates to silver halide photographic materials and especially to photographic silver halide emulsions which can be advantageously used for silver complex diffusion transfer process and methods for producing same.

The theory of the silver complex diffusion transfer process (DTR process) is disclosed in U.S. Pat. No. 2,352,014 and is well known in other various patents and literatures.

In the DTR process, silver complex salts are transferred from a silver halide emulsion layer to an image receiving layer by diffusion and are converted to silver images mostly in the presence of physical development nuclei. For this purpose, the silver halide emulsion layer exposed imagewise is arranged in contact with an image receiving layer or brought into contact with an image receiving layer in the presence of a developing agent and a silver halide complexing agent to convert unexposed silver halide to a soluble silver complex salt.

The silver halide in the exposed areas of silver halide emulsion layer is developed to silver which can no longer be dissolved and so cannot be diffused.

On the other hand, the silver halide in the unexposed areas of the silver halide emulsion layer is converted to a soluble silver complex salt, which is transferred to an image receiving layer where it forms a silver image, ordinarily, in the presence of development nuclei.

These actions of the exposed and unexposed areas are opposite in direct-positive silver halide emulsions. The DTR process has wide uses such as for reproduction of documents, production of lithographic printing plates, production of block copying materials, instantaneous photographs, etc.

As mentioned above, processing according to the DTR process is carried out in the presence of silver halide complexing agents and developing agents.

Silver halide complexing agents which are suitable for use are well known and, for example, there are (1) thiosulfates, (2) thiocyanates, (3) aminethiosulfate anhydride disclosed in U.S. Pat. No. 3,169,962 and (4) cyclic imide compounds disclosed in U.S. Pat. No. 2,857,276. Moreover, it is known that mercapto compounds are good silver halide complexing agents and, for example, Japanese Patent Publication (Kokoku) No. 11957/71 discloses use of various kinds of mercapto compounds in a combined developing and fixing composition.

The complexing agents are mainly incorporated into processing solutions or image receiving elements.

However, although it is depending on the kind of these complexing agents, in alkaline processing solutions, they decompose or react with other compound, e.g., developing agents, to lose complexing action, or their complexing ability decreases during storage of the processing solution or running processing. Therefore, it is preferred, if possible, to incorporate the complexing agents in photographic materials.

For example, the inventors proposed in Japanese patent application No. 84743/79 that lithographic printing plates extremely excellent in ink receptivity can be obtained by incorporating 2-mercaptobenzoic acid which is one of the mercapto compounds described in said Japanese Patent Publication (Kokoku) No. 11957/71 in constituting layers of lithographic printing plates obtained by using DTR process. However, it has been found by the subsequent researchers that even if the mercapto complexing agents for silver are incorporated in layers which are not light sensitive as well as silver halide emulsion layers, there occur problems such as desensitization and softening in tone which are promoted when the photographic materials are stored.

As a result of the inventors' intensive research in an attempt to improve said defects, it has been found that unexpectedly the best results are obtained by incorporating mercapto complexing agents for silver salts in silver halide emulsions at the time of their preparation and said defects can be completely overcome.

SUMMARY OF THE INVENTION

The object of this invention is to provide silver halide photographic materials improved in photographic defects such as desensitization, softening of tone, etc. which are caused by mercapto complexing agents for silver salts and a method for producing same.

Another object of this invention is to provide silver halide photographic emulsions suitable for use in light sensitive materials for silver complex diffusion transfer process which have no photographic problems such as desensitization, softening of tone, etc. caused by mercapto complexing agents for silver salts and are excellent in storage stability and high in sensitivity of spectral sensitization and a method for producing the emulsions.

These objects of this invention are basically accomplished in slver halide photographic materials comprising a support having thereon at least silver halide emulsion layer and, if necessary, constituting layers which are permeable to water through to or out from the silver halide emulsion layer by incorporating mercapto complexing agents in at least one of the layers and anionic or betaine type cyanine sensitizing dyes in said emulsion layer.

DESCRIPTION OF THE INVENTION

The mercapto complexing agents for silver salts used in this invention are represented by the following general formula (A):

$$\text{HS-R-Y or X-R-Y} \qquad \text{(A)}$$

wherein R represents a divalent residue of aliphatic or aromatic hydrocarbons which may have substituents such as mercapto group, hydroxyl group, carboxyl group, halogen atom, alkyl group, alkoxy group, amino group, acylamino group, nitro group, etc. and R is ordinarily an alkylene or arylene of 1–20 carbon atoms such as methylene, ethylene, propylene, butylene, isobutylene, isopropylene, hydroxypropylene ($—CH_2CHOHCH_2—$), carboxylethylene ($—CHCOOHCH_2—$), phenylene, naphthylene, xylylene ($—CH_2C_6H_4CH_2—$), etc., Y represents a water solubilizing group which has an effect of producing compounds more water soluble than the corresponding compounds having no water solubilizing group and especially preferable is a carboxyl group and X represents a group which can be released in an alkaline developing solution to produce HS-group.

The compounds represented by the general formula (A) are known and disclosed, for example, in said Japanese Patent Publication (Kokoku) No. 11957/71. Examples thereof are those which have alkylene group such as mercaptopropanol, α-mercaptopropionic acid, mercaptosuccinic acid, dimercaptoadipic acid, etc. and preferably they are those which have divalent residue of aromatic hydrocarbon such as 2-mercaptobenzoic acid, etc.

As mentioned hereinbefore, 2-mercaptobenzoic acids which may have substituent are preferred for lithographic printing plates which use DTR process and by using these compounds in combination with the sensitizing dyes used in this invention, there can be obtained lithographic printing plates having ink receptivity and printing endurance of such level as cannot be obtained by single use of said compounds. Specific examples of these 2-mercaptobenzoic acids which are also exemplified in said Japanese Patent Publication (Kokoku) No. 84743/79 are 2-mercaptobenzoic acid, 2-mercapto-4-chlorobenzoic acid, 2-mercapto-4-methylbenzoic acid, 2-mercapto-4-methoxybenzoic acid, 2-mercapto-4-acetylaminobenzoic acid, etc.

It is important that these complexing agents become anions thereof in alkaline processing solutions and so these complexing agents when added to silver halide emulsions, etc. may be in the form of salts (e.g., sodium 2-mercaptobenzoate) and moreover may be compounds having a protective group which is easily released by alkalis (the so-called precursors, e.g., S-acetylthiosalicylic acid).

These complexing agents may be used in an amount of about 50 mg-about 50 g per one mol of silver halide and about 1–200 mg per 1 $m^2$ of materials.

The sensitizing dyes used in this invention are known and are characterized by the structure that they have at least one acidic group such as sulfoalkyl, carboxyalkyl, etc. on nitrogen atom of nitrogen-containing heterocyclic rings.

Useful sensitizing dyes are represented by, for example, the following general formula (B):

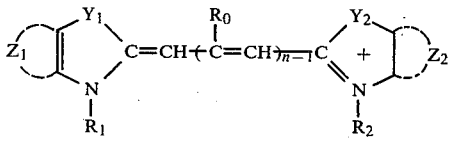

(B)

wherein $Y_1$ and $Y_2$ represent oxygen atom, sulfur atom, selenium atom, $>N-R_3$ ($R_3$ is an alkyl group),

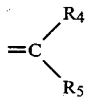

($R_4$ and $R_5$ are alkyl groups) or —CH=CH—, $R_0$ represents hydrogen atom or an alkyl group, $R_1$ and $R_2$ represent alkyl group, aryl group or allyl group which may be substituted, at least one of which is alkyl group substituted with sulfo or carboxyl group, $Z_1$ and $Z_2$ represent a group of non-metal atoms necessary for forming a benzene or naphthalene nucleus which may be substituted and n represents an integer of 1 or 2.

Especially preferred sensitizing dyes are represented by the following general formula (C):

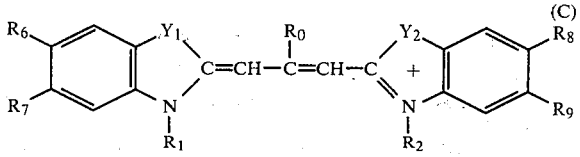

(C)

wherein $R_6$, $R_7$, $R_8$ and $R_9$ represent hydrogen atom, alkyl group, halogen atom, cyano group, or alkoxy group or aryl group which may be substituted, $R_6$ and $R_7$ or $R_8$ and $R_9$ may bond to form a condensed benzene ring and $Y_1$, $Y_2$, $R_0$, $R_1$ and $R_2$ are the same as defined in the general formula (B).

Examples of compounds used as the sensitizing dyes in this invention are as follows:

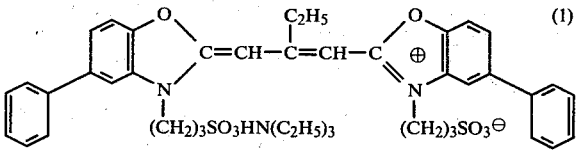

(1)

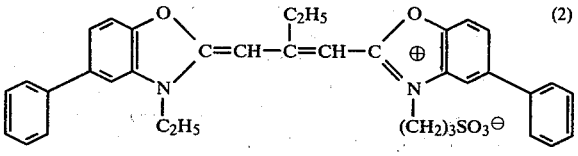

(2)

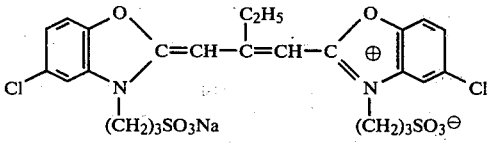

(3)

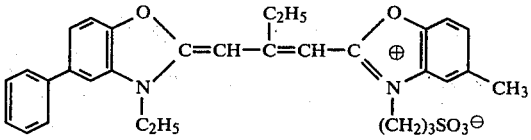

(4)

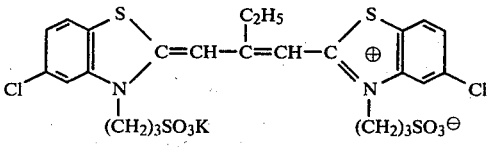

(5)

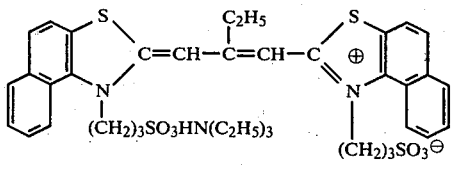

(6)

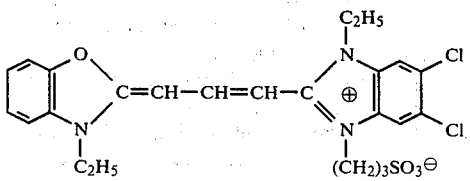

(7)

-continued (8)

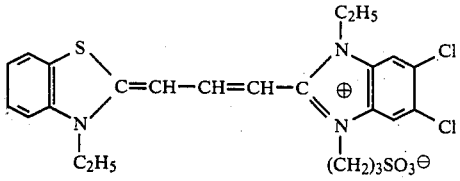

(9)

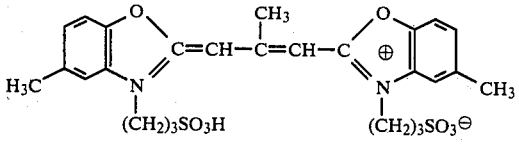

(10)

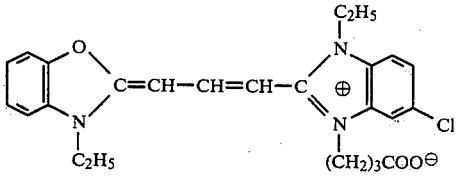

(11)

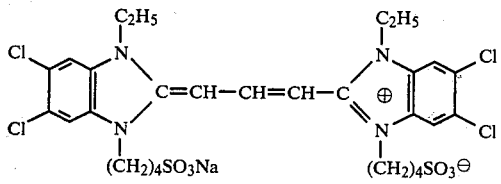

(12)

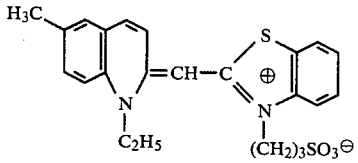

(13)

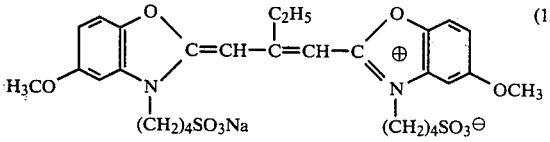

(14)

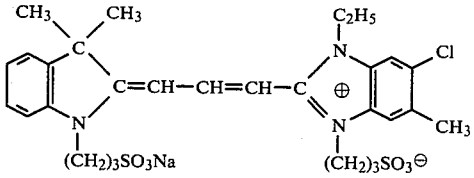

(15)

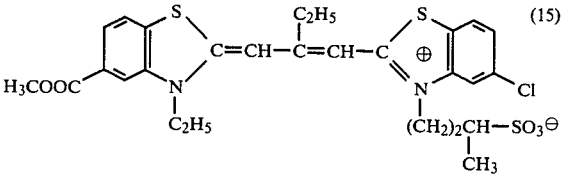

(16)

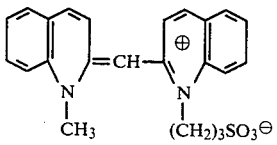

-continued (17)

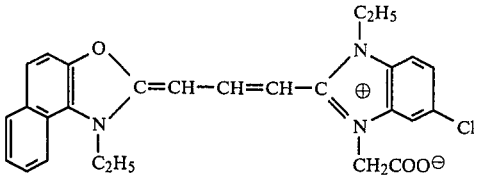

(18)

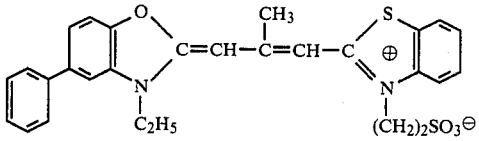

(19)

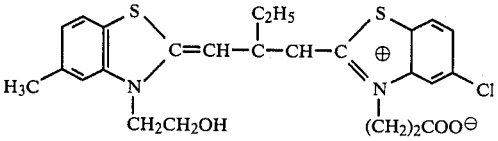

The sensitizing dyes used in this invention are not limited to these compounds enumerated above, and any cyanine dyes of betaine (inner salt) type and anion type may be used and they may not be fallen within the scope of said general formula (B). For example, dyes suitable for use in direct positive silver halide emulsions as disclosed in Japanese Patent Publication (Kokai) No. 25621/77 and No. 21601/78 may also be used.

Examples of these compounds are as follows:

(20)

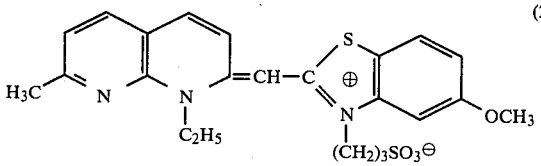

(21)

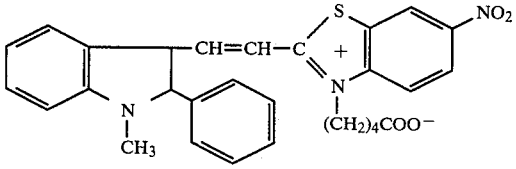

With reference to the specific examples of these compounds, reference can further be made to Japanese Patent Publications (Kokai) No. 3527/73, No. 28224/73 and No. 77224/76 and Japanese Patent Publication (Kokoku) No. 42172/73 and No. 46932/74.

Amount of the sensitizing dyes added is within the range of $10^{-6}$ mol-$10^{-3}$ mol, preferably $5\times10^{-6}$ mol-$1\times10^{-4}$ mol per 1 mol of silver halide.

These sensitizing dyes may be directly added to emulsions or may be added in the form of solutions obtained by dissolving them in water miscible solvents such as methanol, ethanol, pyridine, methyl cellosolve, acetone, dimethylformamide and the like (or mixed solvents thereof) or in water or by diluting them with water. Ultrasonic vibration may be applied to these dye solutions. Moreover, they may be added by the methods as described in U.S. Pat. No. 3,469,987 and Japanese Patent Publication (Kokoku) No. 24185/71. Furthermore, the methods disclosed in U.S. Pat. No. 2,912,345, No. 3,342,605, No. 2,996,287, No. 3,425,835, etc. may also be used.

The sensitizing dyes may be used singly or in combination of two or more of them. Moreover, other dyes may also be used in combination with these sensitizing dyes.

Mercapto complexing agents for silver salts may be added in the same manner as the sensitizing dyes. The complexing agents may be used singly or in combination of two or more or in combination with other complexing agents.

The important characteristics of this invention are, for example, as follows:

(a) The sensitizing dyes used in silver halide emulsions must be anion or betaine type cyanine dyes.

(b) It is especially preferred that the mercapto complexing agents for silver salts contact with silver halide emulsion after the sensitizing dyes have been added (adsorbed) to the silver halide emulsions (grains). Dye ripening explained hereinafter is more preferred.

(c) The best results are obtained when both the sensitizing dyes and complexing agents are added to silver halide emulsions at the time of preparing the emulsions under the conditions (a) and (b).

The object of this invention cannot be attained unless at least the condition (a) is met. For example, when the sensitizing dyes are cation type cyanine dyes or merocyanine dyes, substantially no effect is obtained even if they are added to silver halide emulsions prior to addition of complexing agents. It is common for one skilled in the art to add the sensitizing dyes to silver halide emulsions prior to the addition of antifoggants, hardeners, surfactants, etc. and to leave the emulsion containing the dyes at a certain temperature (e.g., about 40° C.) for a certain period (e.g., about 10–30 minutes) to stabilize the adsorption of the dyes to the silver halide.

The mechanism of this invention is not clear, but not the mere stabilizing effects mentioned above. This is not only because there is selectivity in the kind of the sensitizing dyes, but because the object of this invention can be more completely accomplished when the sensitizing dyes used in this invention are added to silver halide emulsions and thereafter mercapto complexing agents for silver salt are added thereto than when the sensitizing dyes used in this invention are added to silver halide emulsions, then these emulsions are sufficiently stabilized and are coated on a support and on this emulsion layer is coated a water permeable nonlight sensitive layer containing a mercapto complexing agent (these two layers may be coated simultaneously or separately). This fact will be proved by the Examples given hereinafter.

This phenomenon is not seen in the case of anti-foggants such as 1-phenyl-5-mercaptotetrazole which contain mercapto group. The sensitizing dyes used in this invention may be added to silver halide emulsions at any time during the preparation of the emulsions, but ordinarily they are added after completion of chemical ripening of the emulsions. The completion of chemical ripening means the moment when the chemical sensitization such as sulfur or gold sensitization attains the desired optimum sensitivity. Of course, the dyes may be added before completion of chemical ripening, namely, during the chemical ripening or may be added after addition of various additives or adjustment of pH or pAg of emulsions after the chemical ripening. Generally, immediately after the completion of addition of the dyes, the mercapto complexing agents for silver salt may be added. However, it has been found that although, as mentioned hereinbefore, the effects of this invention are not the ordinary stabilization effects, especially preferred effects are obtained when the silver halide emulsions after addition of the sensitizing dyes, but before addition of the mercapto complexing agents for silver salt are ripened for a certain period at a certain temperature (this ripening is called "dye ripening" in this specification). This dye ripening can be conducted irrespective of the time of addition of the sensitizing dyes. Of course, when the sensitizing dyes are added during chemical ripening, the dye ripening can take place at the time of the chemical ripening or the dye ripening can take place over time period extending before or after the chemical ripening.

The conditions for the dye ripening may vary depending to some extent on circumstance, but preferably it is carried out for $15\times(\chi+1)$ minutes at a temperature (°C.) of $60-10\times\chi$ (where $\chi$ is 0 or 0.1–2.0). However, the dye ripening may also be made at a temperature higher than 60° C.

The dye ripening provides favourable results also when the mercapto complexing agents for silver salt are contained in non-light sensitive layers.

As the non-light sensitive layers there are protective layers, undercoat layers (which may be antihalation layers), basecoat layers, intermediate layers, image receiving layers, etc. which may or may not be contiguous to silver halide emulsion layers.

Preparation, dispersion and physical ripening of silver halides used in this invention may be effected by the various known methods and under known conditions. For example, the following various methods and combinations thereof may be conveniently used: ordinary mixing method, converse mixing method, simultaneous mixing method, halide conversion method as disclosed in Japanese Patent Publication (Kokoku) No. 7772/71 and U.S. Pat. No. 2,592,250, ammonia method, acidic or neutral method and alkaline method, ethylenediamine method as disclosed in U.S. Pat. No. 2,448,534 and silver iodide nuclei method as mentioned in Japanese Patent Publication (Kokai) No. 65925/73. There are no special limitations in compositions (e.g., silver chloride, silver iodobromide, silver bromide, silver chlorobromide, silver chloroiodobromide, etc.), crystal form and crystal habit of silver halides, but especially preferable are silver halide emulsions containing at least 70 mol % of silver chloride. Moreover, to the silver halide emulsions (generally during physical ripening) may be added various additives, for example, metal ions such as cadmium, ion, zinc ion, rhodium ion, iridium ion, lead ion, thallium ion, lithium ion, calcium ion and the like and combination of two or more of these ions (e.g., combination of rhodium ion and iridium ion as disclosed in Japanese Patent Publication (Kokoku) No. 33781/74) and various crystal habit regulators such as alkyl pyridinium salts, thiourea, 3-mercapto-4-methyl-5-ethyl-1,2,4-triazole, 1-phenyl-5-mercaptotetrazole, 2-mercapto-benzimidazole, etc. as disclosed in "The Journal of Photographic Science" Vol. 13, 1965.

Furthermore, the silver halide emulsions may be chemically sensitized with various sensitizers. For example, the following sensitizers can be conveniently used: sulfur sensitizers (e.g., hypo, thiourea, gelatins containing unstable sulfur, etc.), noble metal sensitizers (e.g., gold chloride, gold rhodanate, ammonium chloroplatinate, silver nitrate, silver chloride, palladium salts, rhodium salts, iridium salts, ruthenium salts, etc.), polyalkylenepolyamine compounds mentioned in U.S. Pat. No. 2,518,698, etc., iminoaminomethanesulfinic acid mentioned in German Patent No. 1,020,864, reduction sensitizers (e.g., stannous chloride), etc.

As hydrophilic binders which are effectively used for producing light sensitive emulsions in silver halide photographic materials of this invention, there are lime-treated gelatins, acid-treated gelatins, gelatin derivatives (e.g., those which are mentioned in Japanese Patent Publications (Kokoku) No. 4854/63, No. 5514/64, No. 12237/65 and No. 26845/67, U.S. Pat. No 2,525,753, No. 2,594,293, No. 2,614,928, No. 2,763,639, No. 3,118,766, No. 3,132,945, No. 3,186,846, and No. 3,312,553, British Patents No. 861,414 and 1,033,189, etc.), proteins such as albumin, casein, etc., cellulose compounds such as carboxymethylcellulose, hydroxyethylcellulose, etc., natural polymers such as agar, sodium alginate, synthetic hydrophilic binders such as polyvinyl alcohol, poly-N-vinylpyrrolidone, polyacrylic acid copolymers, polyacrylamide, etc., their derivatives or partial hydrolyzates. These hydrophilic binders may be used singly or in combination. These hydrophilic binders may also be favorably used for production of photographic constituting layers containing no silver halide such as antihalation layers, intermediate layers, protective layers, etc.

Various additives may further be contained in constituting elements of silver halide photographic materials.

For example, as hardeners the following may be used: aldehyde compounds such as formaldehyde, glutaraldehyde, etc., compounds containing reactive halogens as mentioned in U.S. Pat. No. 3,288,775 and No. 2,732,303 and British Patents No. 974,723 and No. 1,167,207, etc., ketones such as diacetyl cyclopentanedione, etc., bis(2-chloroethylurea), 2-hydroxy-4,6-dichloro-1,3,5-triazine, divinylsulfon, 5-acetyl-1,3-diacryloyl, hexahydro-1,3,5-triazine, compounds having reactive olefins as mentioned in U.S. Pat. No. 3,635,718 and No. 3,232,763, British Patent No. 994,809, etc. N-hydroxymethylphthalimide, N-methylol compounds as mentioned in U.S. Pat. No. 2,732,316, No. 2,586,168, etc., isocyanates as mentioned in U.S. Pat. No. 3,103,437, acid derivatives as mentioned in U.S. Pat. No. 2,725,294, 2,725,295, etc., carbodiimide compounds as mentioned in U.S. Pat. No. 3,100,704, etc., epoxy compounds as mentioned in U.S. Pat. No. 3,091,537, etc., isoxazole compounds as mentioned in U.S. Pat. No. 3,321,313, No. 3,543,292, etc., halogenocarboxyaldehydes such as mucochloric acid, dioxane derivatives such as dihydroxydioxane, dichlorodioxane, etc., inorganic hardeners such as chrome alum, zirconium sulfate, chromium trichloride, etc.

Furthermore, as antifoggants and stabilizers, those which are mentioned in "Journal of Photographic Society of Japan" 23,34–40 (1960), and 113–117, "Photographic Science and Engineering" 3, 268–271 (1959), U.S. Pat. No. 2,716,062, No. 2,944,900, No. 2,131,038, No. 2,694,716, No. 2,886,437, No. 2,444,605, No. 3,287,135, No. 3,236,652, No. 2,403,927, No. 3,266,897, No. 3,397,987, No. 2,839,405 and No. 3,220,839, British Patent No. 623,448, Japanese Patent Publication (Kokoku) No. 5647/59 and Japanese Patent Publication (Kokai) No. 107129/76 and other known antifoggants and stabilizers may be used. As surfactants there are, for example, saponin, and anionic compounds such as sodium alkylbenzenesulfonate, sulfosuccinic acid esters, alkylarylsulfonates as mentioned in U.S. Pat. No. 2,600,831 and amphoteric compounds as mentioned in U.S. Pat. No. 3,133,816. As other additives there may be used fluorescent brighteners as mentioned in Japanese Patent Publication (Kokoku) No. 7127/59, wetting agents such as wax, glycerides of higher fatty acids, esters of higher alcohols, etc., mordants such as N-guanylhydrazone compounds, quaternary onium compounds, tertiary amine compounds, antistatic agents such as diacetylcellulose, styrene-perfluoroalkylene-sodium maleate copolymer, alkali salts of reaction products of styrene-maleic anhydride copolymer and p-aminobenzenesulfonic acid, etc., matting agents such as polymethacrylic acid esters, polystyrene, colloidal silicon oxide, etc., film property improvers such as acrylic acid esters, various latices, etc., gelatin plasticizers such as glycerine, those mentioned in Japanese Patent Publication (Kokoku) No. 4939/68, thickening agents such as styrene-maleic acid copolymer, those as mentioned in Japanese Patent Publication (Kokoku) No. 21574/61, etc., antioxidants, pH regulators (generally, each constituting layer has a pH of about 4–8), etc.

Various kinds of support may be used for the silver halide photographic materials of this invention. For example, various films such as cellulose nitrate films, cellulose ester films, poly(vinylacetal) films, polystyrene films, polypropylene films, poly(styrene terephthalate) films, polycarbonate films, etc., glass plates, papers, etc. may be effectively used. Of the paper supports, advantageously used are those which are partially acetylated or coated with baryta and/or $\alpha$-olefin polymers, especially those which have 2–10 carbon atoms such as polyethylene, polypropylene, ethylenebutene copolymers, etc. If necessary, these supports may be undercoated. Furthermore, the surface of the supports may be subjected to treatments such as corona discharge, glow discharge, electron bombardment, flame treatment, roughening, ultraviolet ray irradiation, etc.

The silver halide photographic light sensitive materials of this invention may contain other suitably selected various photographic additives besides said additives.

For example, the photographic materials which utilize the DTR process may contain developing agents such as hydroquinone and derivatives thereof, 1-phenyl-3-pyrazolidone and derivatives thereof, etc. as known in many patents and literatures such as Japanese Patent Publications (Kokoku) No. 14893/63, No. 27568/64, No. 28825/70, No. 27435/71, No. 30856/72 and No. 43778/76 and Japanese Patent Publications (Kokai) No. 3332/71 and No. 1223/74, etc. In this case, as the DTR processing solutions, alkali activating solutions containing completely or substantially no developing agents are used. These developing agents are contained in silver halide emulsion layers and/or at least one layer which is permeable to water through to or out from the silver halide emulsion layers. The materials containing about 0.5 g/m$^2$–about 4 g/m$^2$ of silver halide in terms of silver nitrate may contain 0.3–3 g/m$^2$ of hydroquinone or derivative thereof and/or 0.05–1.0 g/m$^2$ of 3-pyrazolidone or derivatives thereof.

This invention can be advantageously applied to lithographic printing materials which utilize the DTR process as mentioned in Japanese Patent Publications (Kokoku) No. 16725/73 and No. 30562/73 and Japanese Patent Publication (Kokai) No. 21602/78.

The processing solutions for processing silver halide photographic materials of this invention include, for example, sodium hydroxide, sodium carbonate, trisodium phosphate, disodium hydrogenphosphate, potassium hydroxide, lithium hydroxide, ammonium hydroxide, etc. which may be used alone or in combination of two or more.

Furthermore, if necessary, the processing solutions may contain generally known additives, for example, inorganic inhibitors such as potassium bromide, etc., organic inhibitors such as benzotriazole, 6-nitrobenzoimidazole, 1-phenyl-5-mercaptotetrazole, etc. (some of which provide the effect of making blue black the color of metallic silver produced upon reduction), calcium chelate compounds such as sodium hexametaphosphate, ethylenediaminetetraacetic acid, etc., complexing agents for silver halide such as potassium thiocyanate, sodium thiosulfate, etc., wetting agents such as sodium alkylsulfonates, sodium alkylsulfates, polyethylene glycol derivatives, saponin, etc., sodium sulfite, various development accelerators, etc. The alkaline activating processing solutions do not substantially contain developing agents and so are not deteriorated with air oxidation and can be used for considerably a long time. However, if necessary, they may contain developing agents.

Furthermore, various treatments known in this field such as stopping, fixing, bleaching, stabilizing, water washing, etc. may also be carried out, if necessary.

EXAMPLE 1

A matting layer containing silica particles of 5 μm in average particle size was provided on one surface of a both surfaces polyethylene coated paper of 135 g/m$^2$. On another surface of this paper which had been corona discharged was provided an antihalation layer containing carbon black and on this layer was coated a silver halide emulsion prepared by chemically sensitizing with gold chloride and sodium thiosulfate a gelatin emulsion containing silver chloride particles of 0.25 μm in average particle size made hard in tone with rhodium salt, adding thereto each of sensitizing dyes shown in Table 1 in an amount of 150 mg per 1 mol of silver halide, leaving the emulsion at 60° C. for 15 minutes and then adding thereto an antifoggant, a stabilizer, a hardener (formalin), a surfactant, silica particles, etc. The amount of silver was 1.5 g/m$^2$ in terms of silver nitrate. After drying, each sample was warmed at 40° C. for 3 days and then was divided into two portions. On one portion was coated 10 g/m$^2$ of palladium sulfide sol prepared as mentioned below and on another portion was similarly coated a nuclei solution of the same palladium sulfide sol as above except containing S-acetylthiosalicylic acid in an amount of 0.3 millimol/m$^2$.

| Preparation of palladium sulfide sol | |
|---|---|
| Liquid A | |
| Palladium chloride | 5 g |
| Concentrated hydrochloric acid | 40 ml |
| Water | 1 l |
| Liquid B | |
| Sodium sulfide | 8.6 g |
| Water | 1 l |

Liquid A was added to liquid B with stirring and after 30 minutes 1 N sodium hydroxide was added to the mixture to adjust pH to 4.0 to obtain a palladium sulfide sol.

The samples which used nuclei liquid containing no S-acetylthiosalicylic acid were called those of group A and those which used nuclei liquid containing S-acetylthiosalicylic acid were called those of group B. Samples of groups A and B immediately after production thereof and samples of group B which had been left at 50° C. and 80% RH for 3 days were sensitometrically exposed and then were developed with the following alkali processing solution at 30° C. for 30 seconds.

| Alkali processing solution | |
|---|---|
| Sodium hydroxide | 20 g |
| Sodium thiosulfate | 10 g |
| Anhydrous sodium sulfite | 50 g |
| Hydroquinone | 10 g |
| 1-phenyl-3-pyrazolidone | 1 g |
| Water to make 1 l | |

After the development, the samples were treated with the following neutralizing solution at 25° C. for 20 seconds.

| Neutralyzing solution | |
|---|---|
| Ethylene glycol | 5 g |
| 20% aqueous solution of colloidal silica | 1 g |
| Citric acid | 10 g |
| Sodium citrate | 35 g |
| Water to make 1 l | |

Dyes used for comparison were as follows:

Comparative dye A

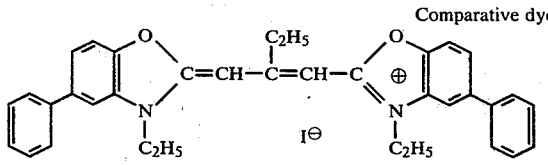

Comparative dye B

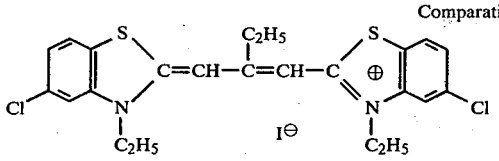

Comparative dye C

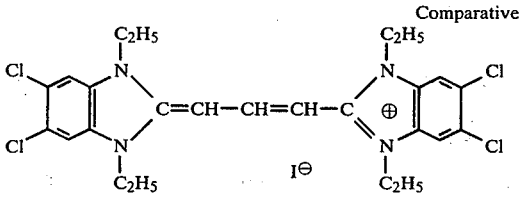

Comparative dye D

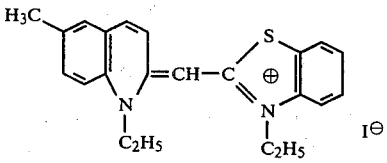

Comparative dye E

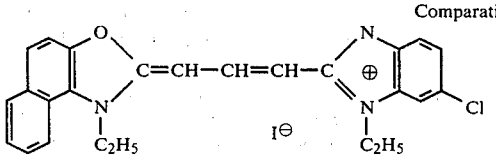

-continued

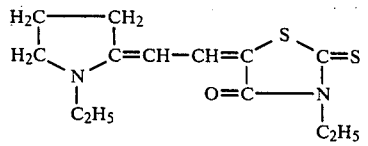

Comparative dye F

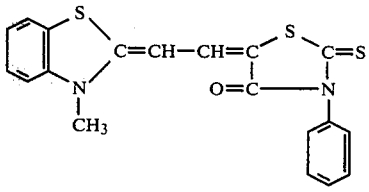

Comparative dye G

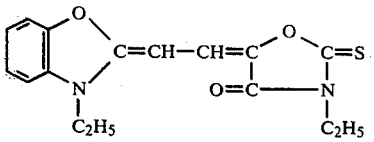

Comparative dye H

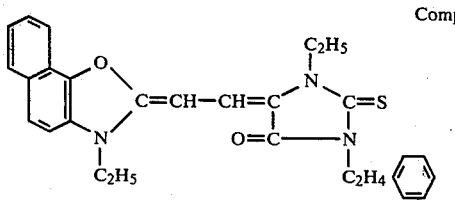

Comparative dye I

Taking the samples of group A immediately after production thereof as standard, relative sensitivity of the samples of group B immediately after production and after storage is shown in Table 1. Sensitivity of samples of group A was taken as 1.0.

TABLE 1

| Sensitizing dyes | Sensitivity immediately after production of the samples | Sensitivity after storage |
|---|---|---|
| Comparative dye A | 0.60 | 0.25 |
| Comparative dye B | 0.60 | 0.25 |
| Comparative dye C | 0.50 | 0.20 |
| Comparative dye D | 0.55 | 0.20 |
| Comparative dye E | 0.55 | 0.20 |
| Comparative dye F | 0.40 | 0.15 |
| Comparative dye G | 0.45 | 0.15 |
| Comparative dye H | 0.40 | 0.15 |
| Comparative dye I | 0.50 | 0.20 |
| Exemplified dye No. (1) | 0.96 | 0.88 |
| Exemplified dye No. (5) | 0.95 | 0.85 |
| Exemplified dye No. (11) | 0.96 | 0.86 |
| Exemplified dye No. (12) | 0.91 | 0.82 |
| Exemplified dye No. (17) | 0.90 | 0.82 |

The samples containing comparative dyes A-I showed extreme reduction in sensitivity due to S-acetylthiosalicylic acid contained in physical development nuclei layer both immediately after production of the samples and after storage for 3 days at 50° C. and 80% RH. It is recognized that the samples containing the dyes No. (1), (5), (11), (12) and (17) of this invention exemplified and enumerated hereinbefore showed great improvement in reduction of sensitivity caused by S-acetylthiosalicylic acid both immediately after the production of the samples and after storage.

EXAMPLE 2

This example shows the influence of sequence of additions of the sensitizing dyes and the mercapto complexing agents for silver salt to the silver halide emulsions.

Lithographic printing plates were produced using the procedure of Example 1 except that the sensitizing dye was added to the silver halide emulsion after completion of chemical ripening and the emulsion was then subjected to dye ripening at 50° C. for 30 minutes and thereafter 2-mercaptobenzoic acid was added in an amount of 50 millimol per 1 mol of silver halide or the sequence of addition of the sensitizing dye and that of 2-mercaptobenzoic acid was reversed. The physical development nuclei layer contained no mercapto complexing agent for silver salt.

The relative sensitivity of the samples is shown in Table 2 taking the sensitivity of each sample of group A (immediately after the production of the sample) in Example 1 as standard sensitivity (1.0).

TABLE 2

| Sensitizing dyes | Sensitizing dyes were added first | | Sensitizing dyes were added later | |
|---|---|---|---|---|
| | Immediately after production of sample | After storage | Immediately after production of sample | After storage |
| Comparative dye A | 0.35 | 0.25 | 0.30 | 0.20 |
| Comparative dye B | 0.35 | 0.25 | 0.35 | 0.25 |
| Comparative dye C | 0.30 | 0.20 | 0.30 | 0.20 |
| Comparative dye D | 0.30 | 0.25 | 0.30 | 0.20 |
| Comparative dye E | 0.35 | 0.20 | 0.30 | 0.20 |
| Comparative dye F | 0.30 | 0.20 | 0.30 | 0.20 |
| Comparative dye G | 0.30 | 0.15 | 0.30 | 0.10 |
| Comparative dye H | 0.30 | 0.20 | 0.30 | 0.15 |
| Comparative dye I | 0.35 | 0.25 | 0.30 | 0.25 |
| Exemplified dye No. (1) | 1.03 | 1.02 | 0.87 | 0.84 |
| Exemplified dye No. (5) | 1.03 | 1.01 | 0.86 | 0.84 |
| Exemplified dye No. (11) | 1.02 | 1.01 | 0.86 | 0.83 |
| Exemplified dye No. (12) | 0.99 | 0.97 | 0.86 | 0.82 |
| Exemplified dye No. (17) | 0.98 | 0.97 | 0.85 | 0.81 |

EXAMPLE 3

This example shows the effect of dye ripening.

To the silver halide emulsions of Example 1 was added dye No. (13) of this invention exemplified hereinbefore in an amount of 150 mg per 1 mol of silver halide and then was added 30 millimoles of 2-mercaptobenzoic acid in accordance with the manners as enumerated below and the emulsions were coated on a support in the same manner as in Example 1. Nuclei layer and antihalation layer were not provided.

(1) After completion of chemical ripening, the dye was added and immediately thereafter the complexing agent was added (Sample 1).

(2) After completion of chemical ripening, the dye was added and after leaving the emulsion at 50° C. for 5 minutes, at 50° C. for 30 minutes and at 50° C. for 60 minutes the complexing agent was added to each of them (Samples 2, 3 and 4, respectively).

(3) Thirty minutes before completion of chemical ripening, the dye was added and immediately thereafter the complexing agent was added (Sample No. 5).

(4) No complexing agent was added in Sample 1 (Comparative Sample).

These samples were sensitometrically exposed, then developed with developing solution D-72 at 20° C. for 60 seconds, fixed and dried. Relative sensitivity and gradation (γ) of each sample taking the sensitivity of the comparative sample as 100 are shown in Table 3.

TABLE 3

| Sample | Relative sensitivity | Gradation (γ) |
|---|---|---|
| Comparative | 100 | 3.6 |
| 1 | 93 | 3.4 |
| 2 | 97 | 3.6 |
| 3 | 104 | 3.7 |
| 4 | 105 | 3.6 |
| 5 | 102 | 3.7 |

It was confirmed that these samples kept the above characteristics even after storage at 50° C. and 80% RH for 3 days.

What we claim:

1. A silver halide photographic material which comprises a support having thereon at least one photographic constituting layer including silver halide emulsion layer, wherein at least one of the constituting layer contains at least one compound represented by the general formulas (A): HS-R-Y or X-R-Y wherein R represents an alkylene or arylene group which may be substituted, Y represents a carboxyl or hydroxyl group and X represents a group capable of being released to produce HS- group and the silver halide emulsion layer contains at least one anion or betaine type cyanide sensitizing dye having one or two acidic groups selected from the group consisting of sulfoalkyl and carboxyalkyl.

2. A silver halide photographic material which comprises a support having thereon photographic constituting layers including silver halide emulsion layer and image receiving layer containing physical development nuclei, wherein at least one of the constituting layers contains at least one compound represented by the general formulas (A): HS-R-Y or X-R-Y wherein R represents an alkylene or arylene group which may be substituted, Y represents a carboxyl or hydroxyl group and X represents a group capable of being released to produce HS- group and the silver halide emulsion layer contains at least one anion or betaine type cyanine sensitizing dye having one or two acidic groups selected from the group consisting of sulfoalkyl and carboxyalkyl.

3. A silver halide photographic material according to claim 1 or 2, wherein R in the general formulas (A) is an arylene group.

4. A silver halide photographic material according to claim 3, wherein Y in the general formulas (A) is a carboxyl group.

5. A silver halide photographic material according to claim 1 or 2, wherein the sensitizing dye is the compound represented by the following general formula (B):

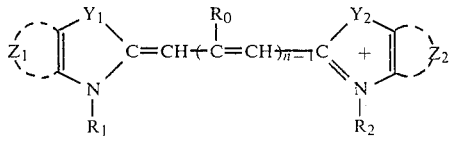

(B)

wherein $Y_1$ and $Y_2$ represent oxygen atom, sulfur atom, selenium atom, $>N-R_3$ ($R_3$ is an alkyl group),

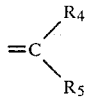

($R_4$ and $R_5$ are alkyl groups) or —CH=CH—, $R_0$ represents hydrogen atom or an alkyl group, $R_1$ and $R_2$ represent alkyl group, aryl group or allyl group which may be substituted, at least one of which is alkyl group substituted with sulfo or carboxyl group, $Z_1$ and $Z_2$ represent a group of non-metal atoms necessary for forming a benzene or naphthalene nucleus which may be substituted and n represents an integer of 1 or 2.

6. A silver halide photographic material according to claim 5, wherein the sensitizing dye is the compound represented by the following general formula (C):

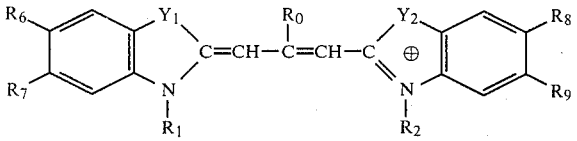

wherein $R_6$, $R_7$, $R_8$ and $R_9$ represent hydrogen atom, alkyl group, halogen atom, cyano group, or alkoxy group or aryl group which may be substituted, $R_6$ and $R_7$ or $R_8$ and $R_9$ may bond to form a condensed benzene ring and $Y_1$, $Y_2$, $R_0$, $R_1$ and $R_2$ are the same as defined in the general formula (B).

7. A silver halide photographic material according to claim 1 or 2, wherein the amount of the compound represented by the general formulas (A) is about 50 mg to about 50 g per 1 mol of silver halide and about 1 mg to about 200 mg per 1 $m^2$ of the material.

8. A silver halide photographic material according to claim 1 or 2, wherein the amount of the sensitizing dye is $10^{-6}$ mol to $10^{-3}$ mol per one mol of silver halide.

9. A silver halide photographic material according to claim 1 or 2, wherein the silver halide emulsion layer contains both the compound represented by the general formulas (A) and the sensitizing dye.

10. A silver halide photographic material according to claim 9, wherein the compound represented by the general formula (A) is 2-mercaptobenzoic acid.

11. A silver halide photographic material according to claim 10, wherein the silver halide emulsion layer comprises silver halide containing at least 70 mol % of chloride.

12. A silver halide photographic emulsion which contains at least one compound represented by the general formulas (A): HS-R-Y or X-R-Y wherein R represents an alkylene or arylene group which may be substituted, Y represents a carboxyl or hydroxyl group and X represents a group capable of being released to produce HS- group and at least one anion or betaine type cyanine sensitizing dye having one or two acidic groups selected from the group consisting of sulfoalkyl and carboxyalkyl.

13. Method for preparing a silver halide emulsion of claim 12, which comprises adding the sensitizing dye first to silver halide, then heating it for a certain period and thereafter adding thereto the compound represented by the general formulas (A).

14. A silver halide photographic emulsion according to claim 12, wherein R in the general formula (A) is arylene group and Y is carboxyl group.

15. A silver halide photographic emulsion according to claim 14, wherein the compound of the general formula (A) is 2-mercaptobenzoic acid.

16. A method according to claim 13, wherein R in the general formula (A) is arylene group and Y is carboxyl group.

17. A method according to claim 13, wherein the compound of the general formula (A) is 2-mercaptobenzoic acid.

* * * * *